US007071816B2

(12) United States Patent
Tewell et al.

(10) Patent No.: US 7,071,816 B2
(45) Date of Patent: Jul. 4, 2006

(54) AUDIBLE ALERT DEVICE AND METHOD FOR THE MANUFACTURE AND PROGRAMMING OF THE SAME

(75) Inventors: Tony J. Tewell, Nampa, ID (US); Tracy C. Lowder, Peoria, IL (US); James E. Barber, Boise, ID (US)

(73) Assignee: Electronic Controls Company, Boise, ID (US)

( * ) Notice: Subject to any disclaimer, the term of this patent is extended or adjusted under 35 U.S.C. 154(b) by 135 days.

(21) Appl. No.: 10/790,536

(22) Filed: Mar. 1, 2004

(65) Prior Publication Data

US 2004/0189445 A1 Sep. 30, 2004

Related U.S. Application Data

(60) Provisional application No. 60/450,831, filed on Feb. 28, 2003.

(51) Int. Cl.
*G08B 3/00* (2006.01)

(52) U.S. Cl. ..... 340/384.1; 340/384.4; 340/384.6; 340/384.7; 340/384.73

(58) Field of Classification Search ..... 340/539.1, 340/539.13, 539.19, 539.22, 539.23, 384.1, 340/384.4, 384.6, 384.7, 10.51, 384.72, 384.73; 310/317; 330/127, 297

See application file for complete search history.

(56) References Cited

U.S. PATENT DOCUMENTS

| | | | | |
|---|---|---|---|---|
| 4,204,200 | A | 5/1980 | Beyl, Jr. | 340/384 |
| 4,275,388 | A | 6/1981 | Hornung | 340/384 |
| 4,603,317 | A | 7/1986 | Gailbreath et al. | 340/463 |
| 5,181,019 | A | 1/1993 | Gottlieb et al. | 340/474 |
| 5,596,311 | A | 1/1997 | Bess et al. | 340/384.7 |
| 5,668,480 | A | 9/1997 | Nintzel | 324/709 |
| 5,780,928 | A * | 7/1998 | Rostoker et al. | 257/713 |
| 6,211,774 | B1 | 4/2001 | Steiner | 340/384.7 |
| 6,339,368 | B1 * | 1/2002 | Leith | 340/384.4 |

* cited by examiner

*Primary Examiner*—Hung Nguyen
(74) *Attorney, Agent, or Firm*—Joseph W. Holland; Holland & Midgley, LLP

(57) ABSTRACT

An audible alert device includes a pulse width modulated signal generator. The audible alert device and method for manufacturing the audible alert device also provides resonant frequency and decibel peaking capabilities. Resonant frequency and decibel peaking routines may conducted at the time of manufacture, upon startup of the alarm or during operation of the alarm. The audible alert device may be programmed during a manufacturing step to exhibit a selected operation mode so that one circuit may be manufactured and programmed to operate in any of a number of operation modes or device configurations. A programming station allows an audible alert device to be programmed during a manufacturing step to exhibit a selected operation mode. Programming may occur by connection of the audible alert device to the programming device by one or more audible alert device power conductors.

7 Claims, 7 Drawing Sheets

AUDIBLE ALERT DEVICE AND METHOD FOR THE MANUFACTURE AND PROGRAMMING OF THE SAME

RELATED APPLICATIONS

This application claims the benefit of Provisional Application Ser. No. 60/450,831 entitled Audible Alert Device and Method for the Manufacture and Programming of the Same, filed Feb. 28, 2003.

BACKGROUND OF THE INVENTION

1. Technical Field

This invention relates to audible alert devices and more particularly to an audible alert device including pulse width modulated signal generation, resonant frequency determination and decibel peaking and a process for the manufacture and programming of a programmable and/or self adjusting audible alert device.

2. Background

Currently, the manufacture of an audible alert device, for instance a backup or reverse motion alert device, includes the steps of circuit assembly and connection of the circuit to a transducer, commonly a voice coil, enunciator or speaker and the circuit is installed in a housing. Next, the circuit may be adjusted, tuned or programmed, for specific or desired output characteristics defining an operation mode. Following assembly of the circuit, transducer and housing, an internal cavity of the housing in which the circuit is installed is cast with a fluid sealing material, for instance, a molten epoxy based potting mixture which cures and hardens to seal the circuit from environmental elements.

Following completion of assembly, as previously described, performance of the circuit may be tested to assure that the circuit and transducer are performing according to selected criteria. Performance criteria may specify output level, output frequency or tone or pulse pattern characteristics all of which may define an operation mode. Devices, for which manufacturing is complete, may be rejected as a result of a failure to meet such criteria. It is believed without being bound by such theory, that the step of potting the circuit within the housing may, in some instances, result in a change in circuit output or performance resulting in a failure of the alert device to meet specific performance criteria and therefore, rejection of the alarm.

There may be advantage in providing a method for the manufacture of an audible alert device which permits adjustment or programming of the circuit following casting with a fluid sealing material, for instance, molten epoxy. Similarly, it is believed that there may be advantage in providing an audible alert device including a circuit which may be programmed or adjusted following casting of the circuit with a fluid sealing material.

Also according to current practices, a separate circuit may be required for each production model, depending on desired output characteristics, i.e. operating output frequencies, output level and signal pattern, and therefore multiple assembly lines, resources or facilities may be required for each of several production models. It is also believed, therefore, that there may be advantage in providing a method for the manufacture of an audible alert device which permits programming of a single circuit to exhibit a pre-selected operation mode selected from a group of operation modes. Each operation mode includes pre-selected output levels, output frequencies or tone or pulse patterns. Similarly, it is believed that there may be advantage in providing an audible alert device including a circuit which may be programmed to exhibit one or more pre-selectable operation modes. One of the obstacles to programming or adjusting the audible alert device circuit following potting with a sealing substance has been the fact that the circuit is largely inaccessible for such programming or adjustment.

There may be advantage therefore in providing a method for the manufacture of an audible alert device which permits adjustment or programming of the circuit, following casting with a fluid sealing material, by transmitting data over one or more conductors that connect to the circuit and, are accessible following casting with a fluid sealing material. Similarly, it is believed that there may be advantage in providing an audible alert device including a circuit which may be programmed or adjusted following casting of the circuit with a fluid sealing material, by transmitting data over one or more power conductors that connect to the circuit and are accessible following casting with a fluid sealing material.

Driving a transducer in an audible alert device, for instance a voice coil, enunciator or speaker at a resonant frequency is considered most efficient and therefore desirable. Following manufacture or as a result of manufacturing process or routine operations, an audible alert device may be subjected to any of a wide variety of environmental and operational conditions. For instance, variations in temperature and humidity, variations in air quality and age of the device may all affect output characteristics of the audible alert device.

There may be advantage found in providing an audible alert device which includes a self adjustment feature which operates by generating a digital feedback signal representative of the current used by the transducer, measured for instance by a sense resistor, which enables adjustment of the circuit so that the circuit operates at an actual resonant frequency as opposed to a calculated resonant frequency.

Similarly, it is believed that there may be advantage in providing a method for manufacturing an audible alert device including an adjustable or self adjusting feature which operates by generating a digital feedback signal representative of the current used by the transducer which enables adjustment of the audible alert circuit so that the circuit operates at an actual resonant frequency as opposed to a calculated resonant frequency.

Various objectives of the present invention may therefore include:

a) providing a method for pulse width modulated signal generation in an audible alert device and an audible alert device including a pulse width modulated signal generation capability;

b) providing a method for resonant frequency determination in an audible alert device and an audible alert device including a resonant frequency determination capability;

c) providing a method for decibel peaking in an audible alert device and an audible alert device including decibel peaking capability;

d) providing a self adjusting audible alert device and a process for the manufacture and programming of a self adjusting audible alert device;

e) providing a method for programming an audible alert device circuit to exhibit a pre-selected operation mode selected from a group of operation modes, each operation mode having pre-selected output levels, output frequencies or tone or pulse patterns;

f) providing an audible alert device and a process for the manufacture and programming of an audible alert device including a self adjustment feature which operates by generating a digital feedback signal representative of the current used by the transducer, and which enables adjustment of the circuit so that the circuit operates at an actual resonant frequency determined either at the time of manufacture, upon startup of the alarm or continuously during operation;

g) providing a method for the manufacture of an audible alert device and an audible alert device including a circuit which may be programmed or adjusted following casting of the circuit with a fluid sealing material; or h) providing a method for the manufacture of an audible alert device and an audible alert device including a circuit which may be programmed or adjusted following casting of the circuit with a fluid sealing material, by transmitting data over one or more power conductors that connect to the circuit and are accessible following casting with a fluid sealing material.

SUMMARY OF THE INVENTION

The present invention is directed to an audible alert device and a process for the manufacture and programming of an audible alert device.

More particularly, the present invention is directed to a method for pulse width modulated signal generation in an audible alert device and an audible alert device including a pulse width modulated signal generation capability.

The present invention is also directed to a method for resonant frequency determination in an audible alert device and an audible alert device including a resonant frequency determination capability.

The present invention is also directed to a method for decibel peaking in an audible alert device and an audible alert device including decibel peaking capability.

The present invention is also directed to a self adjusting audible alert device and a process for the manufacture and programming of a self adjusting audible alert device.

The present invention is also directed to a method for programming an audible alert device circuit to exhibit one or more pre-selectable operation modes having variable output characteristics including output level, frequency and output pattern.

The present invention is also directed to an audible alert device including a self adjustment feature which operates by generating a digital feedback signal representative of the current used by the transducer, which enables adjustment of the circuit so that the circuit operates at an actual resonant frequency determined either at the time of manufacture, upon startup of the alarm or continuously during operation.

The present invention is also directed to an audible alert device including one or more power conductors conductively connected to a device memory and over which data representative of one or more operating output frequencies, one or more operating output levels and one or more operating signal patterns may be transmitted to the memory following the casting of the internal cavity of the housing with the sealing material.

The present invention consists of the device hereinafter more fully described, illustrated in the accompanying drawings and more particularly pointed out in the appended claims, it being understood that changes may be made in the form, size, proportions and minor details of construction without departing from the spirit or sacrificing any of the advantages of the invention.

DETAILED DESCRIPTION

Figure 1:
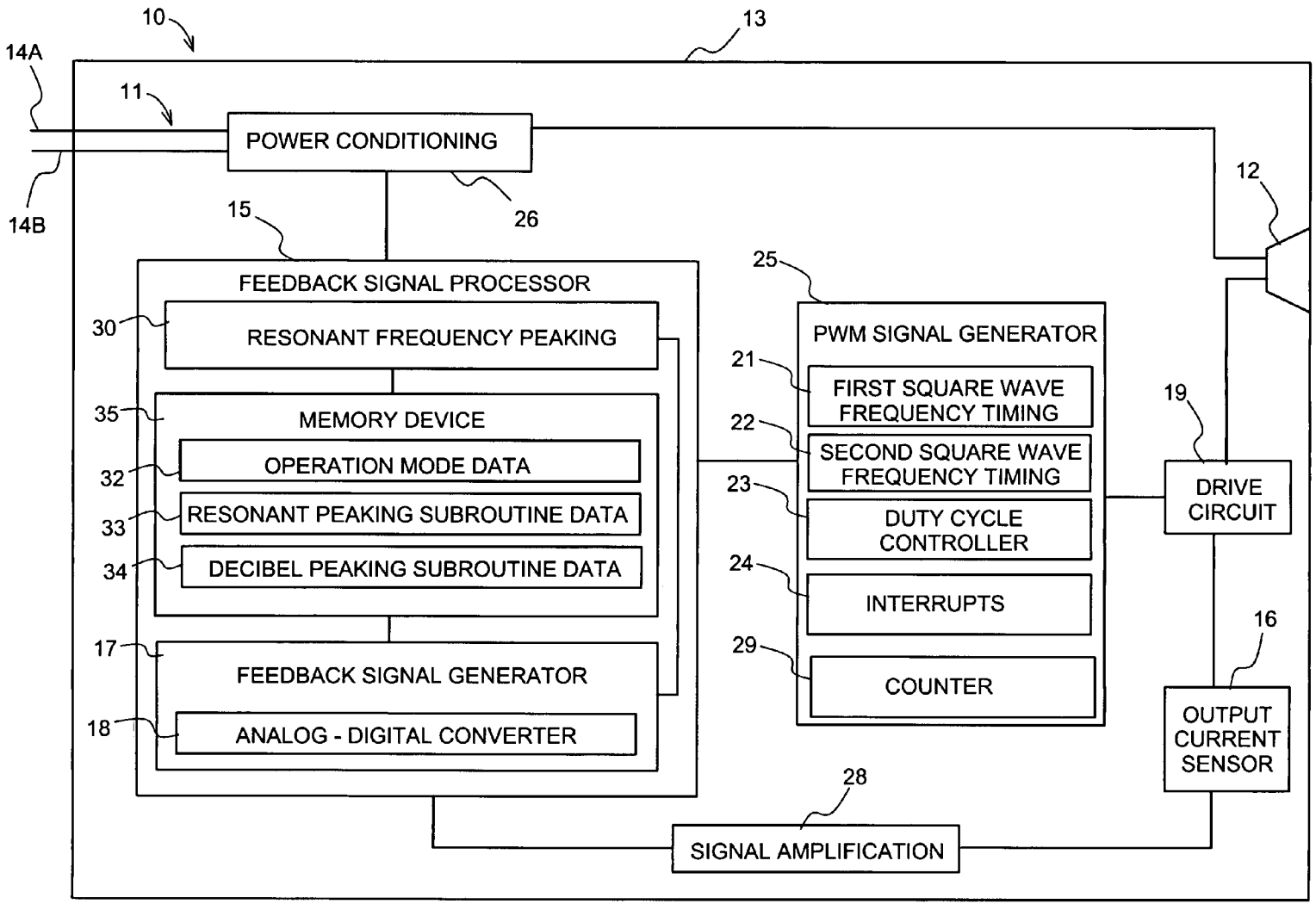
FIG. 1 is a schematic diagram for an audible alert device according to one preferred embodiment of the present invention.
Figure 6:
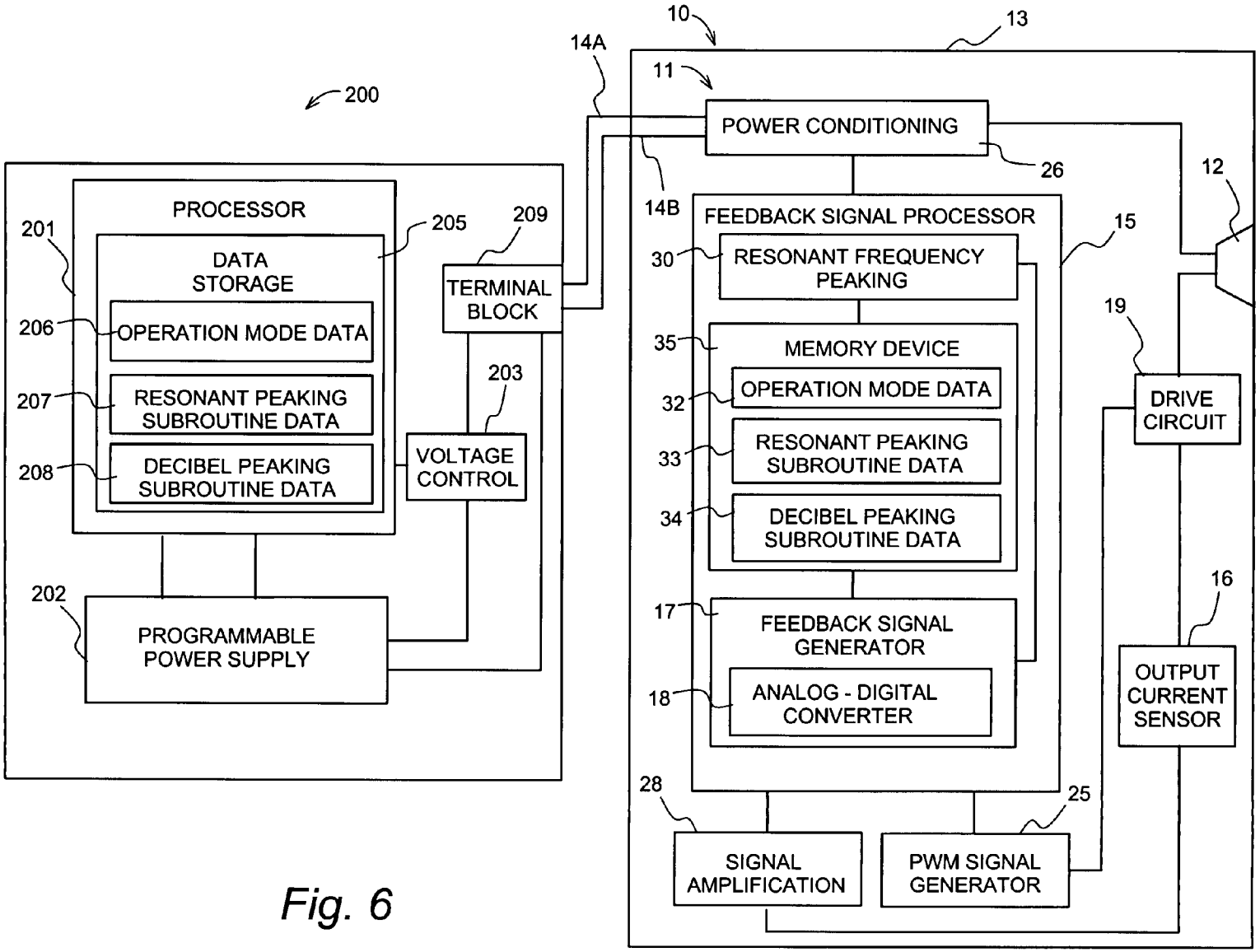
FIG. 6 is a schematic diagram showing an audible alert device programming station according to one preferred embodiment of the present invention.

FIGS. 1 and 6 show an audible alert device 10 according to one preferred embodiment of the present invention. Audible alert device 10 includes circuit 11 enclosed within housing 13 and connected to transducer 12. Circuit 11 is shown including pulse width modulated signal generator 25 conductively connected to feedback signal processor 15. Circuit 11 includes conductors 14A and 14B conductively connected to power conditioning 26 and connectable to a power source, (not shown). Pulse width modulated signal generator 25 is conductively connected to transducer 12 through drive circuit 19. Feedback signal processor 15 is conductively connected to transducer 12 through signal amplification 28, output current sensor 16 and drive circuit 19.

Feedback signal processor 15 includes resonant frequency peaking circuit 30 and feedback signal generator 17 which enable operation of a resonant frequency peaking function that may be performed during a manufacturing stage, or in the alternative, during a startup mode prior to normal operation. Output current sensor 16 is configured as a sense voltage resistor, conductively connected to transducer 12, through drive circuit 19, for sensing a resistance at transducer 12 and generating an analog signal representative of transducer output current level. Feedback signal generator 17 is conductively connected to output current sensor 16. Feedback signal generator 17 includes analog to digital converter 18, which converts an analog signal representative of transducer output current level from output current sensor 16 to a digital value representative of transducer output current level. Resonant frequency peaking circuit 30 processes this digital value and generates a feedback signal representative of transducer output current level. Feedback signal processor 15 is conductively connected to pulse width modulated signal generator 25. Pulse width modulated signal generator 25 is responsive to the feedback signal generated by feedback signal processor 15 to control the output of transducer 12 to operate at an actual resonant frequency.

Referring to FIG. 1, pulse width modulated signal generator 25 includes first square wave frequency timer 21 for controlling an output tone of transducer 12, second square wave frequency timer 22 for controlling an output pattern of the pulse width modulated signal and a duty cycle controller 23 for controlling a decibel output level of the transducer 12. Pulse width modulated signal generator 25 is responsive to an output from feedback signal processor 15. Pulse width modulated signal generator 25 also includes one or more interrupts 24 which may include an external interrupt, a Lite Timer overflow interrupt, Auto-reload timer overflow interrupt, and Auto-reload timer output compare interrupt. Pulse width modulated signal generator 25 also includes counter 29.

Referring to FIGS. 1 and 6, memory device 35, for instance an EEPROM, is conductively connected to resonant frequency peaking circuit 30 and provides storage for operation mode data 32, resonant peaking subroutine data 33 and decibel peaking subroutine data 34.

Figure 2:
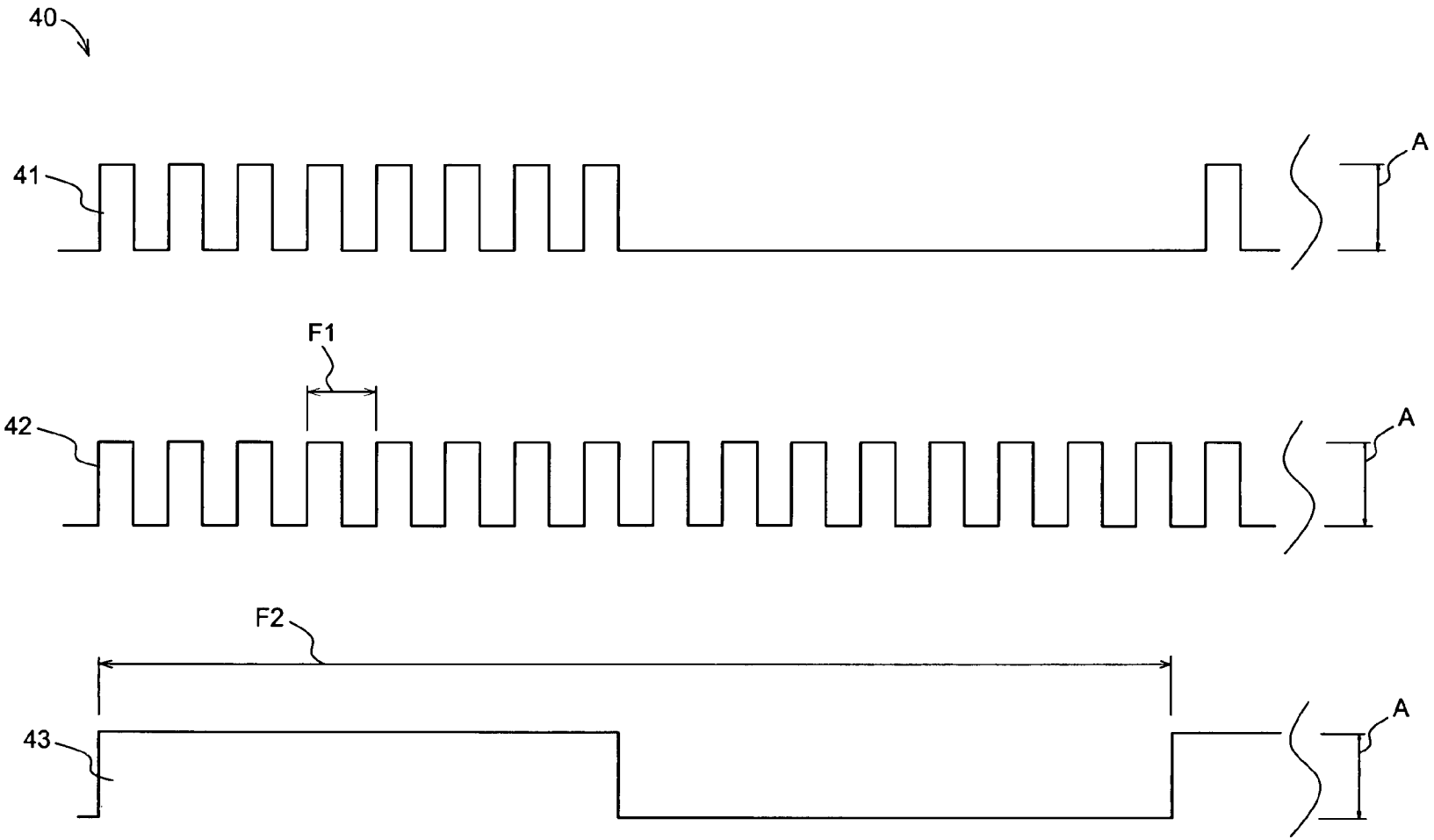
FIG. 2 is a schematic diagram illustrating cyclic pulse width modulated signal generation for an audible alert device according to one preferred embodiment of the present invention.

FIG. 2 is a schematic representation illustrating cyclic pulse width modulated signal generation 40. As shown, cyclic pulse width modulated signal 41 comprises a compound waveform generated by a combination of pulse width modulated signal 42 having a frequency F1 and an amplitude A and square wave 43 having a frequency F2 and an amplitude A. Pulse width modulated signal 42 is generated by first square wave frequency timing element 21, (FIG. 1), and square wave 43 is generated by second square wave frequency timing element 22, (FIG. 1). Cyclic pulse width modulated signal 41 is generated only during the "on-time" of square wave 43. Cyclic pulse width modulated signal 41 is utilized to control and limit the amount of current flowing through transducer 12, (FIG. 1), by control of the duty cycle value of cyclic pulse width modulated signal 41. It has been observed that the higher the frequency of pulse width modulated signal 42, the better the frequency resolution. The higher the frequency of square wave 43, the poorer the frequency resolution.

In one preferred embodiment of the invention, pulse width modulated signal generator 25 is configured as a microcontroller which generates cyclic pulse width modulated signal 42, that is used to drive and control transducer 12. The cyclic pulse width modulated signal 42 is utilized to control drive circuit 19, in one preferred embodiment, a Darlington power transistor. Duty cycle controller 23 controls the volume level of transducer 12, (FIG. 1), by controlling the percent duty cycle of pulse width modulated signal 42. The higher the percent duty cycle, the greater the amount of current allowed through transducer 12.

Referring to FIGS. 1 and 2, in the preferred embodiment of the invention, pulse width modulated signal generator 25 includes a microcontroller which utilizes two timers to generate cyclic pulse width modulated signal 42, first square wave frequency timer 21, in the preferred embodiment, a 12-bit Auto-reload timer and second square wave frequency timer 22, in the preferred embodiment, an 8-bit Lite timer. First square wave frequency timer 21, the 12-bit Auto-reload timer, generates pulse width modulated signal 42 which determines the frequency of the output and therefore output tone at transducer 12. Counter 29 keeps track of microsecond time frames for square wave 43. Second square wave frequency timer 22, the 8-bit Lite Timer, square wave 43, which selectively energizes and de-energizes transducer 12 to create a repeating signal pattern, for instance a back-up alarm mode.

Figure 3:
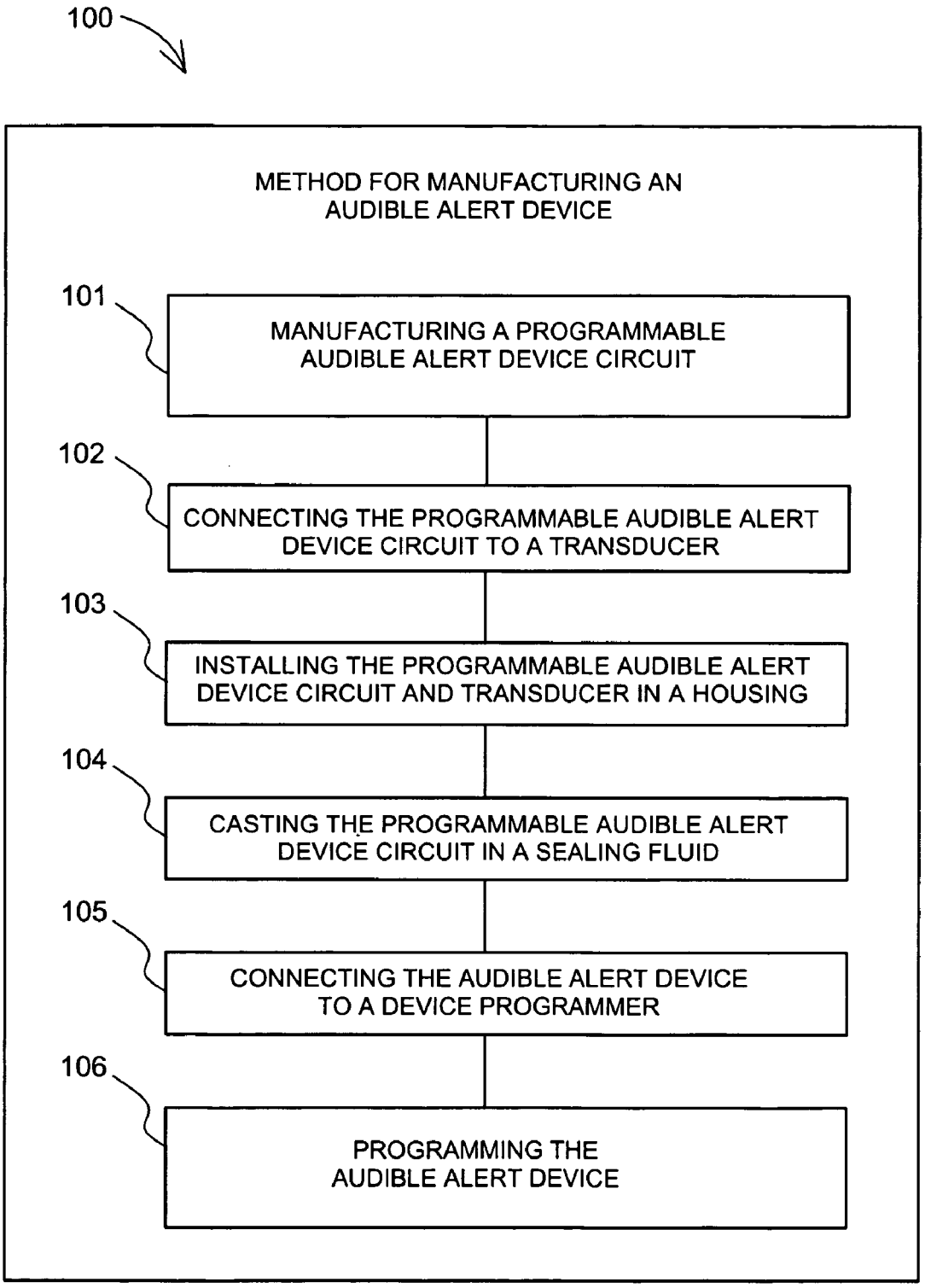
FIG. 3 is a schematic flow chart diagram showing a method for manufacturing an audible alert device according to one preferred embodiment of the present invention.

FIG. 3 shows a METHOD FOR MANUFACTURING A PROGRAMMABLE AUDIBLE ALERT DEVICE 100 including the steps of MANUFACTURING A PROGRAMMABLE AUDIBLE ALERT DEVICE CIRCUIT 101, CONNECTING THE PROGRAMMABLE AUDIBLE ALERT DEVICE TO A TRANSDUCER 102, INSTALLING THE PROGRAMMABLE AUDIBLE ALERT DEVICE AND TRANSDUCER IN A HOUSING 103, CASTING THE PROGRAMMABLE AUDIBLE ALERT DEVICE IN A SEALING FLUID 104, CONNECTING THE AUDIBLE ALERT DEVICE TO A DEVICE PROGRAMMER 105 and PROGRAMMING THE AUDIBLE ALERT DEVICE 106.

Figure 4:
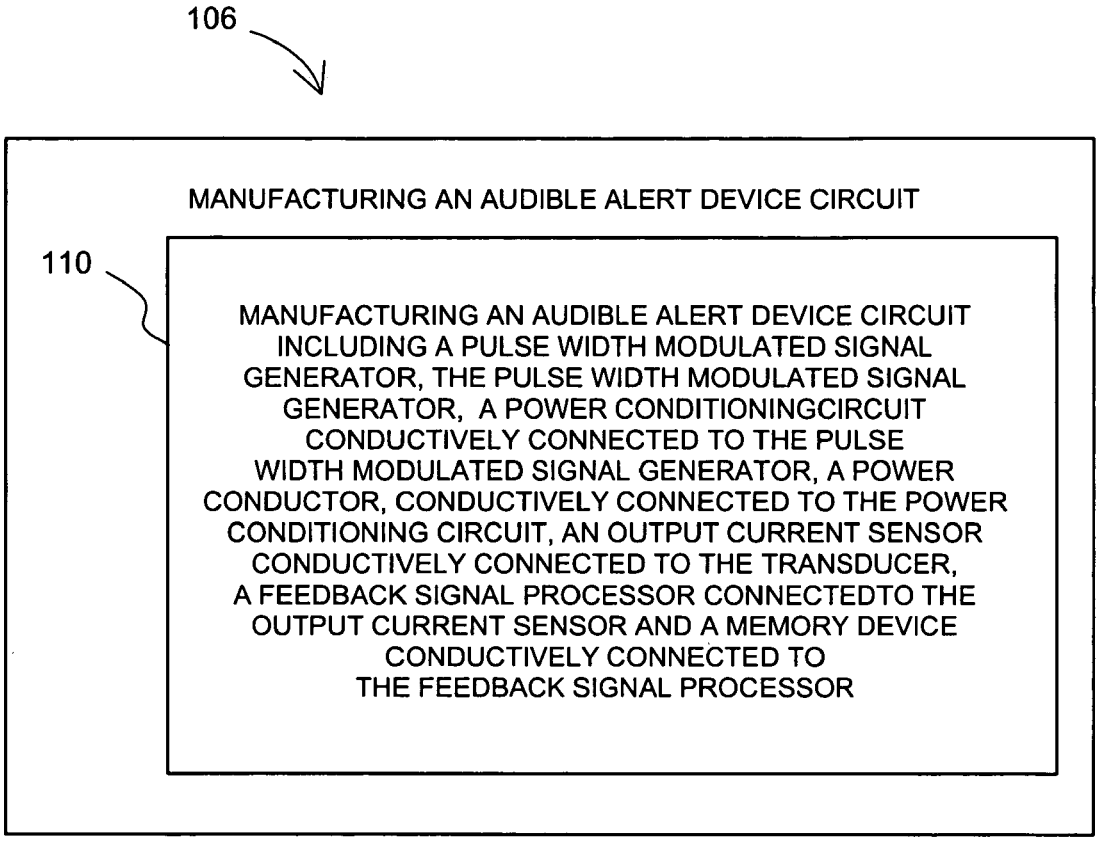
FIG. 4 is a schematic flow chart diagram detailing one step of a method for manufacturing an audible alert device according to one preferred embodiment of the present invention.

As seen in FIG. 4, the step of MANUFACTURING AN AUDIBLE ALERT DEVICE CIRCUIT 101 may include MANUFACTURING AN AUDIBLE ALERT DEVICE CIRCUIT INCLUDING A PULSE WIDTH MODULATED SIGNAL GENERATOR, THE PULSE WIDTH MODULATED SIGNAL GENERATOR INCLUDING A FIRST SQUARE WAVE FREQUENCY TIMER FOR GENERATING A PULSE WIDTH MODULATED SIGNAL, A SECOND SQUARE WAVE FREQUENCY TIMER FOR GENERATING A SQUARE WAVE AND A DUTY CYCLE CONTROLLER FOR CONTROLLING A DECIBEL OUTPUT LEVEL OF THE TRANSDUCER, A POWER CONDITIONING CIRCUIT CONDUCTIVELY CONNECTED TO THE PULSE WIDTH MODULATED SIGNAL GENERATOR, A POWER CONDUCTOR, CONDUCTIVELY CONNECTED TO THE POWER CONDITIONING CIRCUIT, AN OUTPUT CURRENT SENSOR CONDUCTIVELY CONNECTED TO THE TRANSDUCER, A FEEDBACK SIGNAL PROCESSOR CONNECTED TO THE OUTPUT CURRENT SENSOR AND A MEMORY DEVICE CONDUCTIVELY CONNECTED TO THE FEEDBACK SIGNAL PROCESSOR 110.

Figure 5:
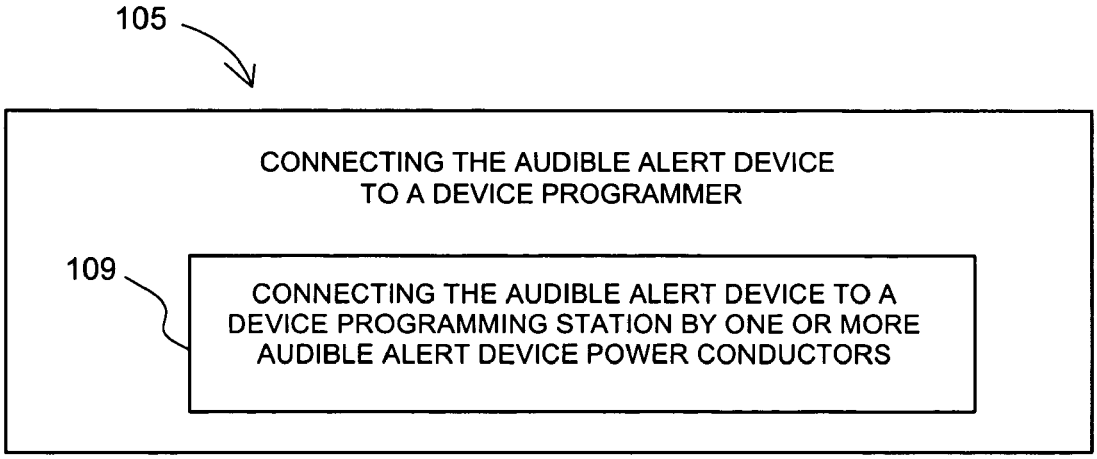
FIG. 5 is a schematic flow chart diagram detailing one step of a method for manufacturing an audible alert device according to one preferred embodiment of the present invention.

As seen in FIG. 5, the step of CONNECTING THE AUDIBLE ALERT DEVICE TO A DEVICE PROGRAMMER 105 may include CONNECTING THE AUDIBLE ALERT DEVICE TO A DEVICE PROGRAMMING STATION BY ONE OR MORE AUDIBLE ALERT DEVICE POWER CONDUCTORS 109.

Audible alert device 10 has two basic modes of operation, a programming mode, described with reference to FIGS. 6 and 7, and normal operations mode, depicted in FIG. 8.

FIG. 6 shows audible alert device 10 connected to audible alert device programming station 200. In the preferred embodiment of the invention, an audible alert device programming station 200 includes processor 201, programmable power supply 202 conductively connected to processor 201 and voltage control 203 conductively connected to programmable power supply 202. Audible alert device 10 is connected to audible alert device programming station 200 using one or more power conductors 14A and 14B through terminal block 209. Processor 201 includes data storage 205 upon which operation mode data 206, resonant peaking subroutine data 207 and decibel peaking subroutine data 208 are stored. Operation mode data 206 may include data representative of various performance specifications for audible alert device 10 depending on a desired or preselected device configuration, performance or mode. For instance, audible alert device 10 may be programmed to operate as a reverse motion or back-up alarm. In the alternative, audible alert device 10 may be programmed to operate as a horn or other warning device. Operation mode data 206, may include output level, output frequency and output pattern. Operation mode data 206 may also include executable self adjustment commands which permit audible alert device 10 to automatically adjust a loudness or output level as a function of varying ambient noise levels as disclosed in U.S. Pat. No. 4,603,317, which is incorporated by reference herein. Resonant peaking subroutine data 207 includes executable routines which permit audible alert device 10 to perform a resonant peaking routine as discussed herein. Similarly, decibel peaking subroutine data 208 includes executable routines which permit audible alert device 10 to perform a decibel peaking routine as discussed herein.

Figure 7:
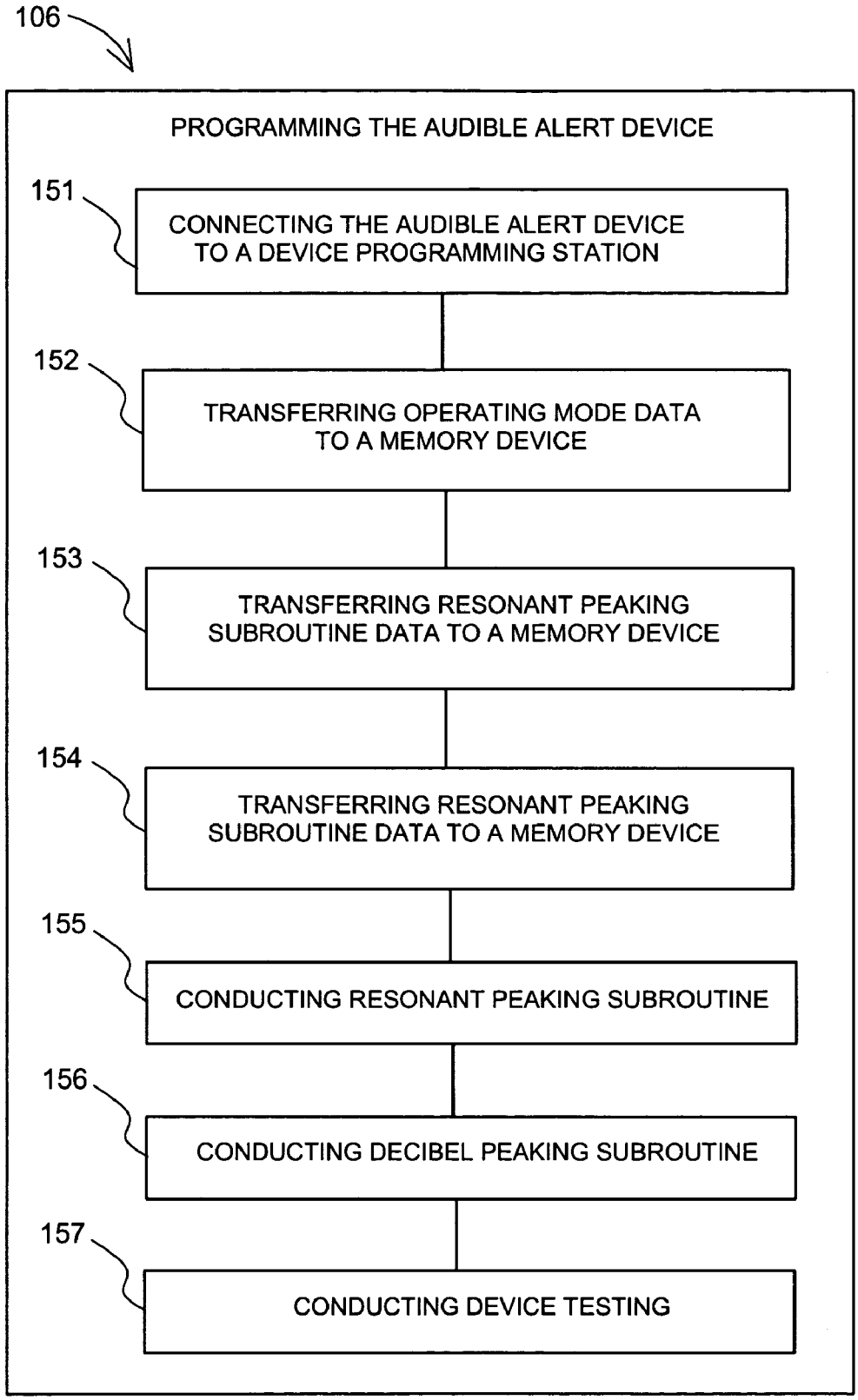
FIG. 7 is a schematic flow chart diagram showing a method for audible alert device programming according to one preferred embodiment of the present invention.

Referring to FIG. 7, the step of PROGRAMMING THE AUDIBLE ALERT DEVICE CIRCUIT 106 includes the steps of CONNECTING THE AUDIBLE ALERT DEVICE TO A DEVICE PROGRAMMING STATION 151, TRANSFERRING OPERATING MODE DATA TO A MEMORY DEVICE 152, TRANSFERRING RESONANT PEAKING SUBROUTINE DATA TO A MEMORY DEVICE 153, TRANSFERRING DECIBEL PEAKING SUBROUTINE DATA TO A MEMORY DEVICE 154, CONDUCTING RESONANT PEAKING SUBROUTINE 155, CONDUCTING DECIBEL PEAKING SUBROUTINE 156 and CONDUCTING DEVICE TESTING 157. During TRANSFERRING OPERATING MODE DATA TO A MEMORY DEVICE 152, and referring to FIG. 6, select operation mode data 206 representative of pre-selected operation mode data selected from a group data for operating audible alert devices in a variety of operation modes is transferred to and copied onto audible alert device 10 memory device 35 as operation mode data 32. Similarly, select data from resonant peaking subroutine data 207 and decibel peaking subroutine data 208 are transmitted to memory device 35 and stored as resonant peaking subroutine data 33 and decibel peaking subroutine data 34 respectively.

Following transfer of data to the audible alert device memory, the method performs CONDUCTING RESONANT PEAKING SUBROUTINE 155. During CONDUCTING RESONANT PEAKING SUBROUTINE 155, a series of different frequencies are output at transducer 12, (FIG. 6), to determine which frequency is a resonant frequency for transducer 12, (FIG. 6). In one preferred embodiment of the invention, CONDUCTING RESONANT PEAKING SUBROUTINE 155 runs through a series of sixty frequencies to determine which frequency is a resonant frequency for transducer 12, (FIG. 6). In another preferred embodiment of the invention, CONDUCTING RESONANT PEAKING SUBROUTINE 155 may run through a series of frequencies in the range of 2 to 100 to determine which frequency is a resonant frequency for transducer 12, (FIG. 6). In one preferred embodiment of the invention, CONDUCTING RESONANT PEAKING SUBROUTINE 155 causes the frequency of cyclic pulse width modulated signal 41, (FIG. 2), to vary from 1049 Hz to 1659 Hz while monitoring a voltage at output current sensor 16, (FIG. 6). CONDUCTING RESONANT PEAKING SUBROUTINE 155 finds a frequency at which voltage across output current sensor 16, (FIG. 6) is at a minimum and stores this value in memory device 35, (FIG. 6).

Following CONDUCTING RESONANT PEAKING SUBROUTINE 155, PROGRAMMING THE AUDIBLE ALERT DEVICE CIRCUIT 106 performs CONDUCTING DECIBEL PEAKING SUBROUTINE 156. CONDUCTING DECIBEL PEAKING SUBROUTINE 156 determines the sense resister voltage value at output current sensor 16, (FIG. 6), which is required to generate a specified decibel output at transducer 12, (FIG. 6). CONDUCTING DECIBEL PEAKING SUBROUTINE 156 is performed after peak frequency has been determined at CONDUCTING RESONANT PEAKING SUBROUTINE 155 in order to allow audible alert device 10, (FIG. 6), to operate at a peak frequency during the routine while audible alert device programming and testing station 200 adjusts voltage level supplied to circuit 11, (FIG. 6). Audible alert device programming and testing station 200, (FIG. 6), monitors a decibel output of transducer 12, (FIG. 6), while the supplied voltage to circuit 11, (FIG. 6), is monitored. When transducer 12, (FIG. 6), generates a specified decibel output, audible alert device programming and testing station 200 levels the voltage supplied to it for a specified period of time, for instance 400 ms. CONDUCTING DECIBEL PEAKING SUBROUTINE 156 waits for the supply voltage to level for the specified period of time then takes a sense resister voltage reading at output current sensor 16, (FIG. 6). This value is stored in memory device 35, (FIG. 6) as a portion of decibel peaking subroutine data 33.

Following CONDUCTING DECIBEL PEAKING SUBROUTINE 156, PROGRAMMING THE AUDIBLE ALERT DEVICE CIRCUIT 106 performs CONDUCTING DEVICE TESTING 155 to assure that audible alert device 10, (FIG. 6), is operating to desired specifications.

Figure 8:
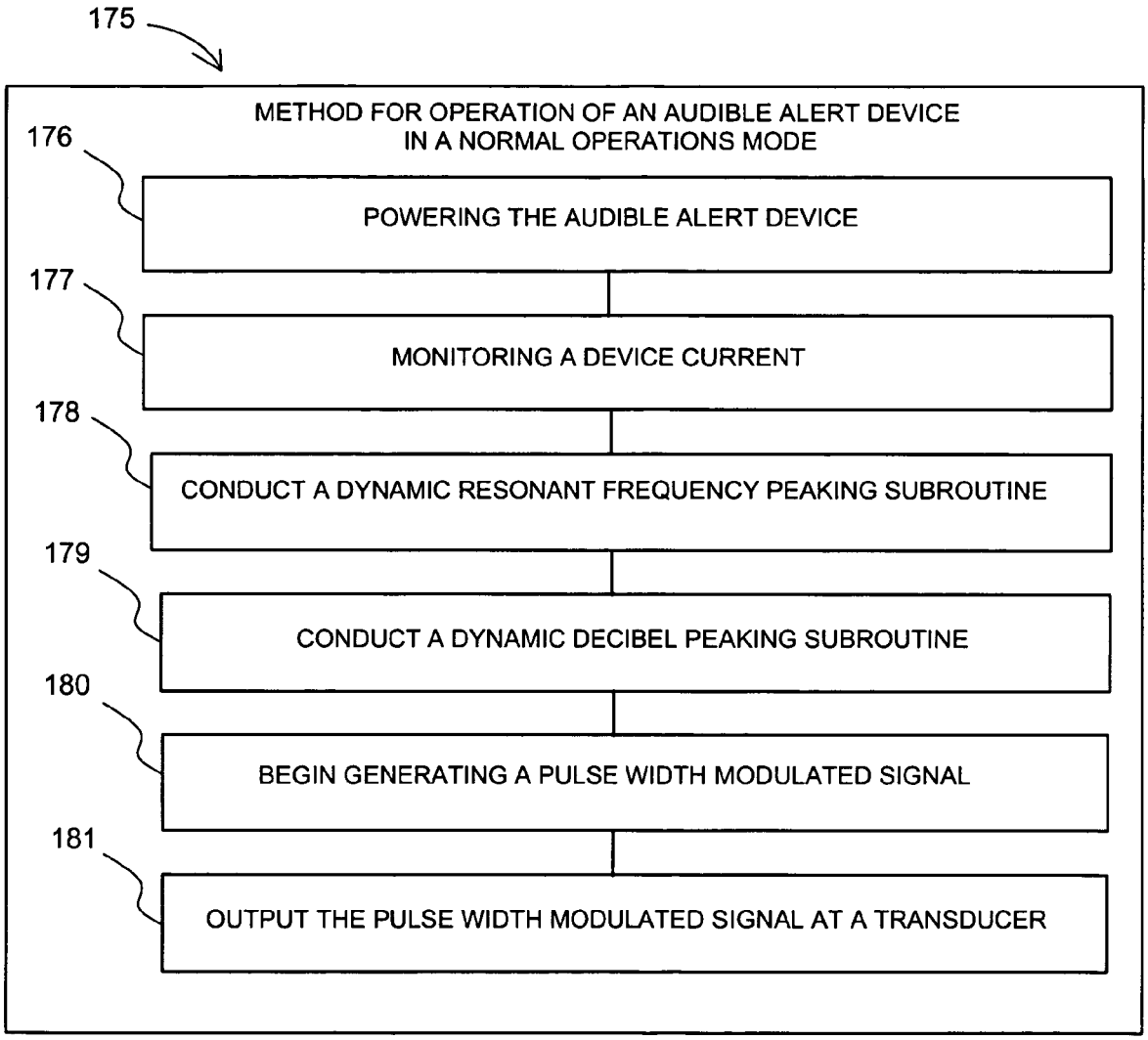
FIG. 8 is a schematic flow chart diagram showing a method for audible alert device operation according to one preferred embodiment of the present invention.

FIG. 8 is a schematic flow chart representation showing METHOD FOR OPERATION OF AN AUDIBLE ALERT DEVICE IN A NORMAL OPERATIONS MODE 175 including the steps of POWERING THE AUDIBLE ALERT DEVICE 176, MONITORING A DEVICE CURRENT 177, CONDUCT A DYNAMIC RESONANT FREQUENCY PEAKING SUBROUTINE 178, CONDUCT A DYNAMIC DECIBEL PEAKING SUBROUTINE 179, BEGIN GENERATING A PULSE WIDTH MODULATED SIGNAL 180, OUTPUT THE PULSE WIDTH MODULATED SIGNAL AT A TRANSDUCER 181.

At POWERING UP THE AUDIBLE ALERT DEVICE 176, audible alert device 10, (FIG. 1), is energized by switching power to circuit 11, (FIG. 1). In a normal operations mode depicted as METHOD FOR OPERATION OF AN AUDIBLE ALERT DEVICE IN A NORMAL OPERATIONS MODE 175, MONITORING A DEVICE CURRENT 177 assures that power supply voltage is measured at a value that is within specified operating parameters. CONDUCT A DYNAMIC RESONANT FREQUENCY PEAKING SUBROUTINE 178 is substantially similar to the step employed at CONDUCTING RESONANT PEAKING SUBROUTINE 155 of PROGRAMMING THE AUDIBLE ALERT DEVICE CIRCUIT 106, (FIG. 7), in that transducer 12, (FIG. 1), is operated through a range of output frequencies. During this output frequency sweep, a determination of an actual resonant frequency is made as a function transducer output. This feature allows the device to make intermittent determinations and readjustments for changes that may occur in the actual resonant frequency of circuit 11, (FIG. 1). CONDUCT A DYNAMIC RESONANT FREQUENCY PEAKING SUBROUTINE 178 finds a frequency at which voltage across output current sensor 16, (FIG. 1) is at a minimum and stores this value in memory device 35.

CONDUCT A DYNAMIC DECIBEL PEAKING SUBROUTINE 179 is substantially similar to the step employed at CONDUCTING DECIBEL PEAKING SUBROUTINE 156 of PROGRAMMING THE AUDIBLE ALERT DEVICE CIRCUIT 106, (FIG. 7), in that is performed after peak frequency has been determined at CONDUCT A DYNAMIC RESONANT FREQUENCY PEAKING SUBROUTINE 178 in order to allow audible alert device 10, (FIG. 1), to operate at a peak frequency. At CONDUCT A DYNAMIC DECIBEL PEAKING SUBROUTINE 179, a voltage level is adjusted by circuit 11, (FIG. 1), while decibel output of transducer 12, (FIG. 1), and the voltage at output current sensor 16, (FIG. 6), are monitored. When transducer 12, (FIG. 1), generates a specified decibel output, the voltage is leveled and held for a specified period of time, for instance 400 ms. CONDUCT A DYNAMIC DECIBEL PEAKING SUBROUTINE 179 waits for the supply voltage to level for the specified period of time then takes a sense resister voltage reading at output current sensor 16, (FIG. 1). This value is stored in memory device 35, (FIG. 1).

Although FIGS. 1 and 6 show a device that has been programmed so that upon energization, the device initiates operation by running the dynamic peaking subroutine, it is contemplated that audible alert device 10 may be programmed to initiate a dynamic peaking subroutine at selected intervals or upon indication that a pre-selected output voltage value at output current sensor 16, (FIG. 1), is sensed or recorded.

At BEGIN GENERATING A PULSE WIDTH MODULATED SIGNAL 180, pulse width modulated signal generator 25 initiates generation of a pulse width modulated signal. At OUTPUT THE PULSE WIDTH MODULATED SIGNAL AT A TRANSDUCER 181, pulse width modulated signal is output at transducer 12.

While this invention has been described with reference to the detailed embodiments, this is not meant to be construed in a limiting sense. Various modifications to the described embodiments as well as the inclusion or exclusion of additional embodiments will be apparent to persons skilled in the art upon reference to this description. It is therefore contemplated that the appended claims will cover any such modifications or embodiments as fall within the true scope of the invention.

What is claimed is:

1. A method for manufacturing an audible alert device includes the steps of:

manufacturing a programmable audible alert device circuit including a pulse width modulated signal generator conductively connected to the transducer, a power conditioning circuit conductively connected to the pulse width modulated signal generator, a power conductor, conductively connected to the power conditioning circuit, an output current sensor conductively connected to the transducer, a feedback signal processor connected to the output current sensor and a memory device conductively connected to the feedback signal processor;

connecting the programmable audible alert device circuit to a transducer;

installing the programmable audible alert device circuit and transducer in a housing;

casting the programmable audible alert device circuit in a sealing fluid;

connecting the audible alert device to a device programming station; and programming the audible alert device.

2. The method for manufacturing an audible alert device of claim 1 wherein the step of connecting the audible alert device to a device programming station includes connecting the audible alert device to the device programming station by one or more power conductors of the programmable audible alert device.

3. The method for manufacturing an audible alert device of claim 1 wherein the step of programming the audible alert device includes transferring operation mode data to the memory device, the operation mode data representative of pre-selected operation mode data selected from a group data for operating audible alert devices.

4. The method for manufacturing an audible alert device of claim 1 wherein the step of programming the audible alert device includes transferring resonant peaking subroutine data to the memory device.

5. The method for manufacturing an audible alert device of claim 1 wherein the step of programming the audible alert device includes transferring decibel peaking subroutine data to the memory device.

6. The method for manufacturing an audible alert device of claim 1 wherein the step of programming the audible alert device includes conducting a resonant peaking subroutine.

7. The method for manufacturing an audible alert device of claim 1 wherein the step of programming the audible alert device includes conducting a decibel peaking subroutine.

* * * * *